US005345790A

United States Patent [19]

Schouten

[11] Patent Number: 5,345,790

[45] Date of Patent: Sep. 13, 1994

[54] YARN TENSIONER FOR KNITTING MACHINE

[76] Inventor: Petrus C. Schouten, Raadhuisstraat 49, NL-1016 DD Amsterdam, Netherlands

[21] Appl. No.: 56,174

[22] Filed: May 3, 1993

[30] Foreign Application Priority Data

May 18, 1992 [DE] Fed. Rep. of Germany ... 9206600[U]

[51] Int. Cl.[5] ..... D04B 15/44; B65H 59/22

[52] U.S. Cl. ..... 66/146; 242/150 R

[58] Field of Search ..... 66/146, 147 R; 242/149, 242/150 R, 147 R

[56] References Cited

U.S. PATENT DOCUMENTS

| | | | |
|---|---|---|---|
| 2,029,943 | 2/1936 | Reiners et al. | 242/150 R |
| 3,356,050 | 12/1967 | Urscheler | 242/150 R |
| 3,967,657 | 7/1976 | Cugini | 242/150 R X |
| 4,535,609 | 8/1985 | Goller et al. | 66/146 |
| 4,693,068 | 9/1987 | Matas Gabalda | 242/147 X |
| 4,763,491 | 8/1988 | Wilson et al. | 66/146 |
| 5,156,105 | 10/1992 | Wang | 242/150 X |

*Primary Examiner*—Clifford D. Crowder
*Assistant Examiner*—John J. Calvert
*Attorney, Agent, or Firm*—James F. Kirk

[57] ABSTRACT

A yarn tensioner or brake for textile knitting machines having several tensioners on a support rod, each tensioner having a pair of tension cups which are pressed against each other by compressed springs supported from a stationary support. In a first embodiment, a stationary tension cup forms the stationary support and a floating tension cup alternates with respect to a stationary tension cup of an adjacent tensioner. The stationary tension cups have cylindrical protruding guides which slip fit into and guide the floating tension cups. In another embodiment, a stationary support supports compressed springs on both sides. The stationary support is formed of a circular support wall which has cylindrical protrusions on opposing sides and sized to slip fit into respective floating tension cups. A pair of stationary supports positioned on the support rod to support and guide opposing floating tension cups against each other. Each respective floating tension cup is driven by a respective coil spring. A first tension cup in each pair of tension cups that form a tensioner, has at least one nose guide that is positioned to be received by a receiving hole in a second tension cup. The nose guide is typically wedge shaped with an outer surface of the nose guide that is sloped inward to the center of the tensioner to force displacement of the floating tension cup as the yarn is pressed in between the first and second tension cups.

11 Claims, 2 Drawing Sheets

YARN TENSIONER FOR KNITTING MACHINE

Under 35 U.S.C. 119, this application claims the filing date or priority date of prior filed German Patent Application Serial Number G 92 06 600.3 filed 18 May 1992, for a "Fadenspanner" with inventor Petrus Coenradus Schouten.

FIELD OF THE INVENTION

The invention relates to a yarn tensioner for textile machines, especially knitting machines which have several adjacently arranged tensioners. The tensioners have tension cups which float against each other and which are pressed against each other by means of springs.

RELATED ART

For the feed of different yarns to a knitting machine it is desirable that the yarn is kept under a constant light tension. To achieve this yarn tensioners are used which can be installed on the knitting machine, as shown in British patent GB-PS 2 173 517, issued 4 Jan. 1989. The yarn tensioner shown in this publication has several tensioners that are adjacently mounted to a stationary rod of rectangular cross section. Each of the tensioners has two floating tension cups axially positioned against each other. The tensioning cups are pressed against each other by coil springs that wind around the square rod.

In each case, one thread is guided between the tensioning cups of one tensioner. The friction between the tensioning cups provides a constant tension for the thread of yarn. In order to prevent the yarn from jumping out of the tensioner, the tensioning cups have protrusions and recesses that fit into each other. By moving axially one of the tension cups against the force of the coil springs the guiding protrusions and recesses can be separated and the yarn can be inserted.

In the case of the well known yarn tensioner of Wilson, characterized in U.S. Pat. No. 4,763,491, the springs are supported by the adjacent tension cups of the adjacent tensioner. This arrangement has the effect that the forces generated by the springs increase when more threads of yarn or thicker threads are inserted into the tensioners. These effects are undesirable.

SUMMARY OF THE INVENTION

The object of this invention is to provide a yarn tensioner of the above type that maintains a constant level of tension in the yarn regardless how many threads of yarn are inserted in the tensioner or how thick the yarn is.

The object of this invention is achieved by providing a stationary support for each spring used in a tensioner. According to this invention, at least one spring of each tensioner is independently supported from a stationary support location and independent from the other springs. The spring forces cannot add up. Moreover, the tension force in each of the tension cups of each tensioner will be constant and always equal regardless of the number of threads of yarn that are inserted into the tensioner.

In a first Embodiment the invention provides that each tensioner always has a stationary tension cup that provides support for a floating tension cup. In each case, a floating tension cup will axially alternate with respect to a stationary tension cup of the adjacent tensioner. It is advantageous to have protruding guides on the stationary tension cups for the guidance of the movable tension cups on the stationary tension cups.

In another alternative embodiment, a stationary support is provided between each tensioner supporting a spring on each side. In this embodiment, the points of support have protruding guides on opposing sides, each protruding guide providing co-axial telescopic guidance for its respective adjacent floating tension cups. It is advantageous to make the guiding protrusions cylindrical.

In another alternative embodiment of the invention, each corresponding pair of tension cups have a protruding nose guide and a corresponding receiving hole; whereby, each protruding nose guides have an outer or topmost surface that slopes inward toward the center of the support rod. As a fiber or yarn or thread is forced between opposing tension cups, the fiber displaces the tension cups as it slides on and past the outer surface of the nose guide, inward toward the support rod; thereby, facilitating the insertion of the thread. This invention provides that each pair of tension cups have at least one yarn guide that comprises a protruding nose guide on one tension cup and a corresponding receiving hole to receive the nose guide on the corresponding and opposing tension cup. The thread or yarn passes between the support rod and the nose guide. The yarn nose guides rise on an incline toward the center of the tensioner in order to make it easier to insert the yarn. There should be two yarn guides for each tensioner, and they should form an angle in a plane normal to the axis of the support rod and measured with respect to the central axis of the support rod.

PREFERRED EMBODIMENT

Figure 1:
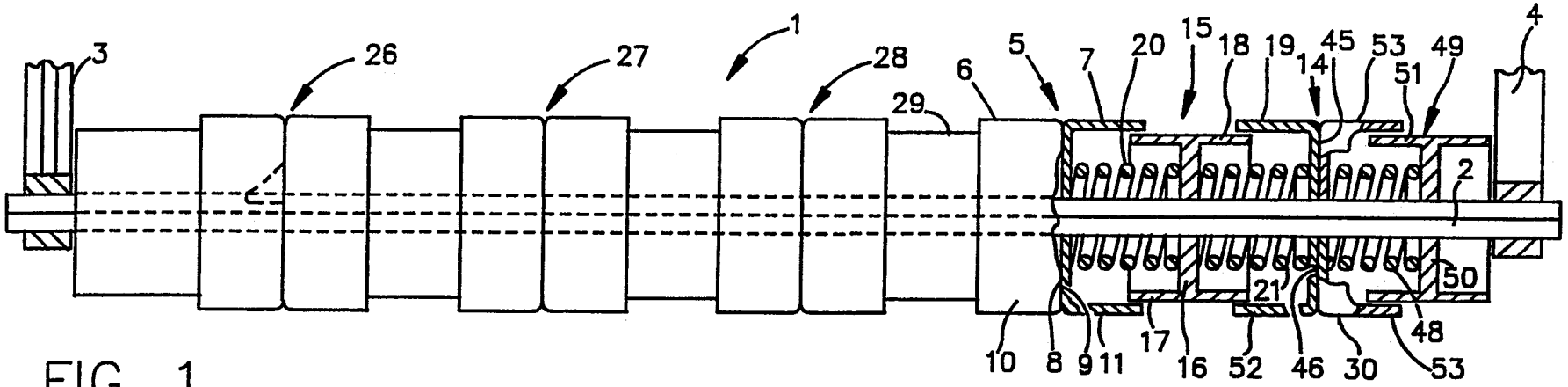
FIG. 1 is a top elevation view of the yarn tensioner in partial section.

FIG. 1 shows a first embodiment of the yarn tensioner 1 in which a stationary support, such as circular support wall 16 is provided between each of five tensioners 5, 14, 26, 27 and 28. The yarn tensioner shown in FIG. 1 has a supporting rod 2 of square cross section. The ends of the rod are supported by a bracket 3, 4—only partially shown—so that the rod cannot turn. By means of brackets 3, 4 the yarn tensioner is mounted on a knitting machine as shown in FIG. 1 of British patent B-2 173 517, which corresponds to FIG. 1 in U.S. Pat. No. 4,763,491, issued Aug. 16, 1988 to Trevor E. Wilson et al, the entire contents of which are incorporated herein by reference..

Referring again to FIG. 1, five yarn tensioner such as tensioner 5 are assembled on the support rod 2. Each tensioner has two tension cups 6, 7, 19, 30. The tension cups 6, 7, 19, 30 are cup shaped and each has a cylinder 10, 11, 51, 52 ending in a base or flat circular tensioner face walls 8, 9,45, 46. As can be seen from FIG. 3 and 4, the tension cups 6, 7, 19, 30 have in their center a square hole 12, 13 that fits the cross section of the supporting rod 2. The supporting rod 2 penetrates the holes 12, 13. The tensioner cups 6, 7, 19, 30 can float axially but cannot rotate on the supporting rod 2.

Between two adjacent tensioners 5, 14, one finds a support cylinder or stationary support 15 shown as an example. This stationary support 15, 49 is formed by a circular support wall 16, 50 which is mounted stationary to the support rod 2. The support wall carries the cylindrical protruding guides 17, 18, 51 on opposing sides. The stationary support 49 provides circular support wall 50 and cylindrical protruding guide 51 to support and encase compressed spring 48. The outside diameter of the protruding guides 17, 18, 51 is such that they slipfit into the inside of the cylindrical walls 10, 11, 52, 53 of the tension cups 7,19, 30 and provide guidance for the tension cups 6, 19. The support wall 16 supports compressed coil springs 20, 21. The support wall 50 supports compressed spring 48. A support wall (not shown) within stationary support 29 supports a compressed coil spring (not shown) that drives tension cup 6 to the right against tension cup 7. Tension cup 7 is driven to the left against tension cup 6 by compressed coil spring 20. The springs are compressed between the support wall and the adjacent tension cups 7, 19. Since there is always a support cylinder or stationary support 15, 49 positioned on opposing sides of each tensioner 5, 14 the tension cups 19, 30 will be pressed together by the compressed coil springs, such as the compressed coil spring 21 within protruding guide 18 and compressed coil spring 48 within protruding guide 51 with a predetermined force.

Figure 3:
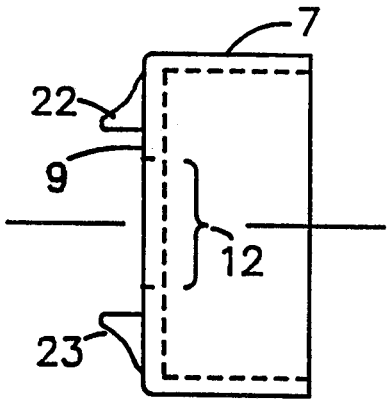
FIG. 3 is a top elevation view of a tension cup.
Figure 4:
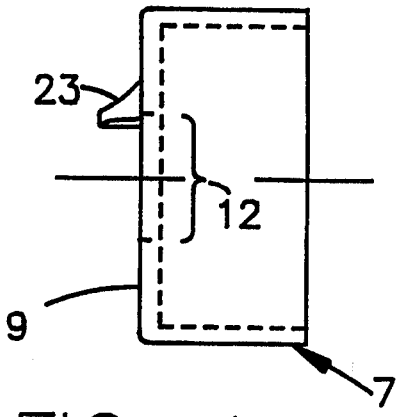
FIG. 4 is a side elevation view of a tension cup.
Figure 5:
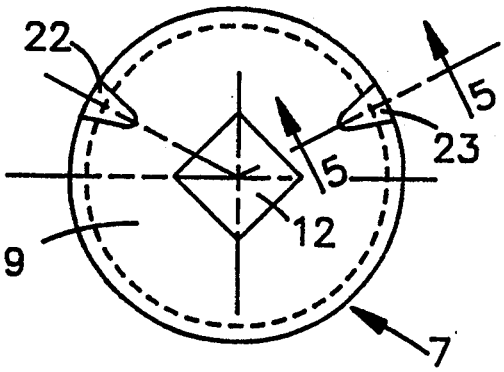
FIG. 5 is a front elevation view of a tension cup 7 showing two nose guides.
Figure 6:
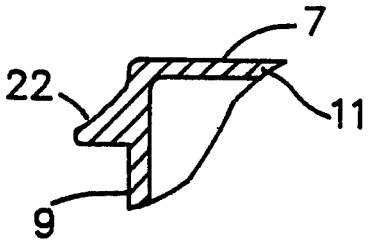
FIG. 6 is a partial section of FIG. 5 taken on line 5—5 through nose guide 22.
Figure 7:
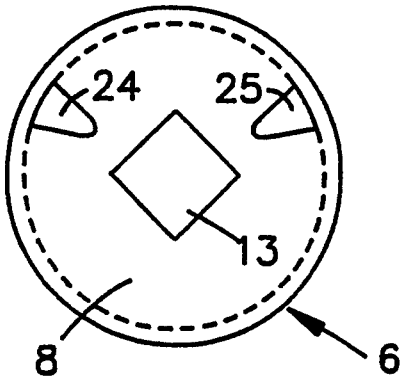
FIG. 7 is a front elevation view of a tension cup 6 showing a first and second receiving hole or first and second recess for receiving corresponding first and second nose guides.

FIG. 3 is a front view of the tension cup 6 of FIG. 1 looking from the left, showing flat circular face wall 9 and FIG. 5 is a sectional view of the region within phantom circle "A" of FIG. 3 taken on section line 5—5. FIG. 4 is a front view of the tension cup 7 of FIG. 1 looking from the right at flat circular face wall 8. As can be seen from FIGS. 3 and 5 the tension cup 6—like all other tension cups of the same design—has two nose guides 22, 23 for the guidance of the yarn. They form an angle of 125 degrees to each other and ascend to the middle in an arch. The adjacent tension cup 7 has fitting recesses 24, 25 into which the lugs for the guidance of the yarn protrude when the tension cups 6, 7 mesh their tension faces 8, 9 together.

In order to generate tension the yarn is pressed between the two tension cups 6, 7. First the tension cups 6, 7 are separated according to the thickness of the yarn. By pressing further the yarn runs along the curved part of the nose guides 22, 23. By doing this the tension cups 6, 7 are separated till the yarn can catch behind one or both guiding lugs 22, 23. The tension cups 6, 7 snap back and clamp the yarn with a certain force. If the yarn is pulled, friction between the tension cups will brake the yarn; this will result into a certain tension of the yarn.

Figure 2:
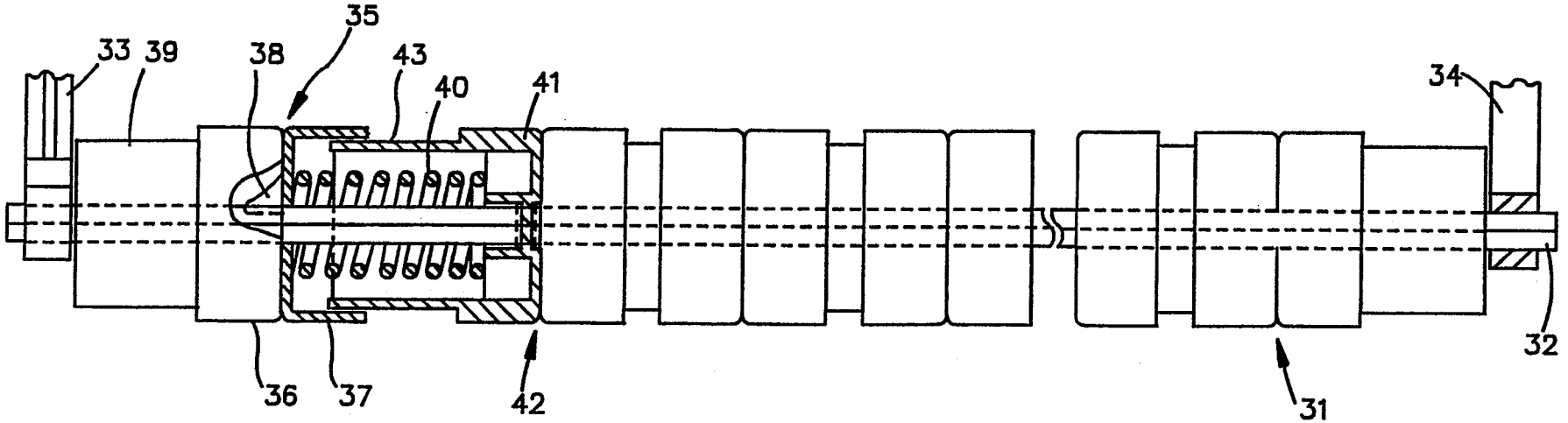
FIG. 2 is a top elevation view of an alternative embodiment of the yarn tensioner in partial section.

FIG. 2 depicts an alternative embodiment of the invention as yarn tensioner 31. This embodiment also has a supporting rod 32 of a square cross section. The rod is supported at its ends by the mounting bracket 33, 34. A series of tensioners—such as 35—are located on the support rod 32. Each tensioner has two tension cups 36, 37. The cross section of the tension cup 37, on the right side, like the tension cups 6, 7 of the yarn tensioner of design configuration 1 has the shape of a cup. Tension cup 37 has two nose guides such as nose guide 38 for the guidance of the yarn, and is free to float axially on the supporting rod 32. Stationary tension cup 36 on the left side is solidly fixed to the support rod 32 and ends in a smaller cylinder 39 that nests inside the adjacent tension cup, similar to tension cup 37. The outside diameter of the cylinder 39 is smaller than the inside diameter of the adjacent, floating tension cup 37. The floating tension cup 37 is guided telescopically by the outside edge of the protruding cylinder 43.

The floating tension cup 37 is pressed by the internal compressed coil spring 40 against the adjacent stationary tension cup 36. The coil spring 40 is supported by the stationary tension cup 41 of the adjacent tensioner 42.

The outside diameter of the cylinder 43 is smaller than the inside diameter of the adjacent, floating tension cup 37. The floating tension cup 37 is guided telescopically by the outside edge of the protruding cylinder 43.

The insertion of the yarn is done in the same manner as described in the description of the yarn tensioner of design configuration 1.

I claim:

1. A yarn tensioner for textile machines comprising:

a support rod, at least a first and second tension cup, (19, 30) each tension cup having a respective flat tension face wall, (45, 46) each tensioning cup being axially positioned and free to slide on the support rod (32) and orientated to position a respective flat tension face wall against an opposing respective flat tension face wall preparatory to receiving a yarn fiber therebetween;

a first and second compressed spring; (21, 48) and a first and second stationary support (15, 49), each stationary support having a support wall (16, 50) supporting a respective protruding guide (18, 51), the stationary supports being positioned on and fixed to the support rod on opposing sides of the tensioner; each respective protruding guide encasing a respective compressed spring, (21, 48) each respective protruding guide (18, 51) being slip fit into a corresponding adjacent tension cup (19, 30);

each respective compressed spring being co-axially positioned to apply a restoring force from a respective support wall, to a respective tension cup to urge a respective flat tension face wall towards the opposing flat tension face wall.

2. The yarn tensioner of claim 1 wherein each respective tension cup and each respective protruding guide is cylindrical, and each respective support wall is circular.

3. The yarn tensioner of claim 1 wherein said first and second compressed springs are coil springs.

4. The yarn tensioner of claim 1 wherein the support rod is substantially square and wherein the first and second tension cups each have a square aperture for slideably receiving the support rod, and a cylindrical aperture, and wherein each respective support wall has a substantially square aperture for receiving the support rod;

each respective spring being a coil spring having an cylindrical aperture characterized to receive the support rod, the support rod passing through the respective square apertures, each respective protruding guide having a cylindrical external surface for insertion into a respective cup and a cylindrical aperture for receiving a respective coil spring.

5. The yarn tensioner of claim 1 wherein the floating tension cups (19, 30) have yarn nose guides (22, 23) that protrude into a respective receiving hole (24, 25) located on an opposing flat tension face wall; and wherein each said yarn nose guide (22, 23) has an outer edge that is arcuately inclined to ascend to the center of the tensioner (14).

6. The yarn tensioner according to claim 5, wherein a first and a second nose guide are formed to protrude from the flat circular tension face wall of a tension cup, the nose guides being positioned on respective first and second radials extending outward from a center of the flat circular tension face wall, the radials being separated by a predetermined angle to each other.

7. A yarn tensioner for textile machines comprising:

a support rod (32), a first and second stationary support (15, 49), each stationary support having a support wall (16, 50) supporting a respective cylindrical protruding guide (18, 51), the stationary supports being axially positioned on the support rod on alternate sides of the tensioner (14);

first and second compressed springs, each respective compressed spring having a respective first end co-axially positioned within a corresponding cylindrical protruding guide and supported by the corresponding support wall;

at least a pair of floating tension cups to form a tensioner (14), each tension cup having a flat tension face wall and a receiving cylindrical cup, a second end of each compressed spring being inserted into a corresponding receiving cylindrical cup, the compressed springs providing restoring force to a corresponding floating tension cup with respect to the respective support wall;

the tensioning cups being axially and slideably positioned on the support rod, each respective cylindrical protruding guide being telescopically coupled to a respective cylindrical receiving cup, the tension cups being orientated on the support rod to position respective flat tension face walls against each other preparatory to receiving a yarn fiber therebetween, both floating tension cups being free to axially move a respective corresponding flat tension face wall against the yarn fiber passing therebetween to frictionally brake the yarn fiber passing between the opposing flat tension face walls and to hold the fiber in tension as the fiber is drawn between the corresponding flat tension face walls, both floating tension cups being free to move axially in response to force from a corresponding compressed spring between a respective receiving cylindrical cup and a respective support wall.

8. The yarn tensioner of claim 7 wherein the floating tension cups (19, 30) have at least a first yarn nose guide (22, 23), that protrudes into a respective receiving hole (24, 25) located on an opposing flat tension face wall; and wherein each said yarn nose guide (22, 23) has an outer edge that is arcuately inclined to ascend to the center of the tensioner (14).

9. The yarn tensioner according to claim 8, wherein a first and a second nose guide are formed to protrude from the flat circular tension face wall of a tension cup, the nose guides being positioned on respective first and second radials extending outward from a center of the flat circular tension face wall, the radials being separated by a predetermined angle to each other.

10. A yarn tensioner for textile machines comprising:

a support rod having at least three sides, at least a first and second tension cup, (19, 30) each tension cup being cylindrical with a cylindrical aperture and having a base with a respective flat tension face wall, (45, 46) each tensioning cup being axially positioned and free to slide on the support rod (32) and orientated to position a respective flat tension face wall against an opposing respective flat tension face wall preparatory to receiving a yarn fiber therebetween;

a first and second compressed coil spring; (21, 48) and a first and second stationary support (15, 49), each stationary support having a circular support wall (16, 50) supporting a respective cylindrical protruding guide (18, 51), the stationary supports being positioned on and fixed to the support rod on opposing sides of the tensioner; each respective protruding guide having a cylindrical external surface for telescopic insertion into a respective tension cup and a cylindrical aperture for receiving a respective coil spring; each respective spring having an cylindrical aperture characterized to receive the support rod;

each respective compressed spring being co-axially positioned to apply a restoring force from a respective support wall, to a respective tension cup to urge a respective flat tension face wall towards the opposing flat tension face wall; and wherein the floating tension cups (19, 30) have yarn nose guides (22, 23) that protrude from the flat circular tension face wall of a tension cup into a respective receiving hole (24, 25) located on an opposing flat tension face wall.

11. The yarn tensioner according to claim 10, wherein each nose guide is positioned on respective first and second radials extending outward from a center of the flat circular tension face wall, the radials being separated by a predetermined angle to each other.

* * * * *